United States Patent [19]

Ziegler et al.

[11] Patent Number: 4,594,824

[45] Date of Patent: Jun. 17, 1986

[54] TELESCOPING TOWER FOR FLOODLIGHTING EQUIPMENT AND THE LIKE

[75] Inventors: Theodore J. Ziegler, Golden; Alexander Eydelman, Littleton; Frederick G. Koether, Boulder; Robert A. Lawrance, Lakewood, all of Colo.

[73] Assignee: Over-Lowe Company, Inc., Englewood, Colo.

[21] Appl. No.: 363,058

[22] Filed: Mar. 29, 1982

[51] Int. Cl.[4] ..... B66C 23/06

[52] U.S. Cl. ..... 52/118; 52/115; 52/117; 248/654

[58] Field of Search ..... 52/111, 115, 116, 117, 52/118; 248/654, 658; 182/141

[56] References Cited

U.S. PATENT DOCUMENTS

| | | | |
|---|---|---|---|
| 1,264,063 | 4/1918 | Guichard . | |
| 1,325,053 | 12/1919 | Steidle . | |
| 1,337,487 | 4/1920 | Schlatter . | |
| 2,128,712 | 8/1938 | Neff | 52/118 |
| 2,613,060 | 10/1952 | Trahan . | |
| 2,826,280 | 3/1958 | Troche et al. . | |
| 2,887,191 | 5/1959 | Lovell | 52/115 |
| 3,196,991 | 7/1965 | Johnson et al. | 52/115 |
| 3,267,625 | 8/1966 | Holzschuh et al. | 52/111 |
| 3,624,979 | 12/1971 | Pryzybylski . | |
| 3,793,794 | 2/1974 | Archer et al. | 52/115 |
| 3,882,964 | 5/1975 | Schellenberg | 182/141 |
| 4,027,802 | 6/1977 | Reynolds | 52/118 |
| 4,062,156 | 12/1977 | Roth | 52/111 |
| 4,082,191 | 4/1978 | Whittingham | 52/115 |
| 4,137,535 | 1/1979 | Rupprecht | 52/118 |
| 4,276,727 | 7/1981 | Salomatin et al. | 52/118 |

*Primary Examiner*—Carl D. Friedman
*Assistant Examiner*—Michael Safavi
*Attorney, Agent, or Firm*—Wm. Griffith Edwards

[57] ABSTRACT

A telescoping mast assembly for floodlighting equipment or other apparatus is arranged to be raised by admitting pressurized fluid to the interior of the assembly and lowered by releasing the fluid. The assembly is constructed of light metal, such as aluminum alloy, and includes a plurality of telescoping hollow members, or tubes, each inner member having a pair of substantially spaced wear rings near its lower end for maintaining the spaced positions of the members and a fitting at its outer end carrying an internally mounted wear ring for maintaining the spacing at the outer end. The telescoping members do not engage one another but are spaced by the wear rings. The fitting is readily detachable and facilitates the use of straight lengths of standard aluminum tube stock for the mast sections. The fittings include keys slidably engaging longitudinal slots in the members for preventing rotation of the members with respect to one another. Seals are provided for preventing leakage of fluid between the members. The wear ring of the pair remote from the lower end engages the wear ring in the fitting when the members are fully raised, the wear rings acting as stops at the outer end of the movement of the members. The wear rings cooperate to provide a low friction, smoothly acting mast assembly which may be easily and quickly raised and lowered and which operates smoothly and effectively without metal-to-metal contact and the likelihood of galling of the aluminum or other light metal of the telescoping sections of the mast.

16 Claims, 9 Drawing Figures

TELESCOPING TOWER FOR FLOODLIGHTING EQUIPMENT AND THE LIKE

This invention relates to telescoping masts or towers for raising equipment such as portable floodlight assemblies to positions high above the ground.

Extensible masts or towers comprising a plurality of telescoping sections have been used heretofore for elevating floodlighting assemblies and various other types of equipment. The sections may be raised or extended to form the tower by devices such as pulleys and reeved cables, or by hydraulic or pneumatic pressure. When the tower is raised by hydraulic or pneumatic fluid under pressure, suitable seals are provided between the sections and guides or bearings may be provided to facilitate the movement of the sections with respect to one another. It is desirable to provide a tower of lightweight material, particularly for uses which may involve air transportation of the equipment from one site to another. It also is desirable that the extension and collapsing of the tower be effected smoothly and rapidly. Accordingly, it is an object of this invention to provide a telescoping tower assembly of the fluid-pressure-actuated type including an improved arrangement of bearings or guides for controlling the relative movement of the telescoping sections during the raising and lowering of the tower.

It is another object of this invention to provide an improved self-sustained, fluid-actuated telescoping tower.

It is another object of this invention to provide a telescoping tower or mast of lightweight material and including an improved arrangement for effecting smooth telescoping movement of the tower sections.

BRIEF SUMMARY OF THE INVENTION

Briefly, in carrying out the objects of this invention, in one embodiment thereof, the telescoping sections of a mast or tower are constructed of lightweight aluminum alloy tubing and are provided with low friction wear rings which maintain the lateral spacing of adjacent tubular sections. Two of the rings in the inner end portion of each section are spaced a distance which is about the length of the overlap of the sections when extended. A similar ring is mounted on the inside of the upper end of each of the outer sections and on extension of the mast engages the nearer ring on the inner section and acts as a stop limiting the outward movement of the respective inner sections. Suitable fluid seals are provided adjacent the outer ends of the outer sections and the inner ends of the inner sections to prevent the escape of the pressure fluid.

Further objects and advantages of the invention will become apparent as the following description proceeds, and the novel features which characterize the invention will be pointed out with particularity in the claims annexed to and forming a part of this specification.

BRIEF DESCRIPTION OF THE DRAWINGS

For a better understanding of this invention, reference may be had to the accompanying drawings in which.

DETAILED DESCRIPTION

Figure 1:
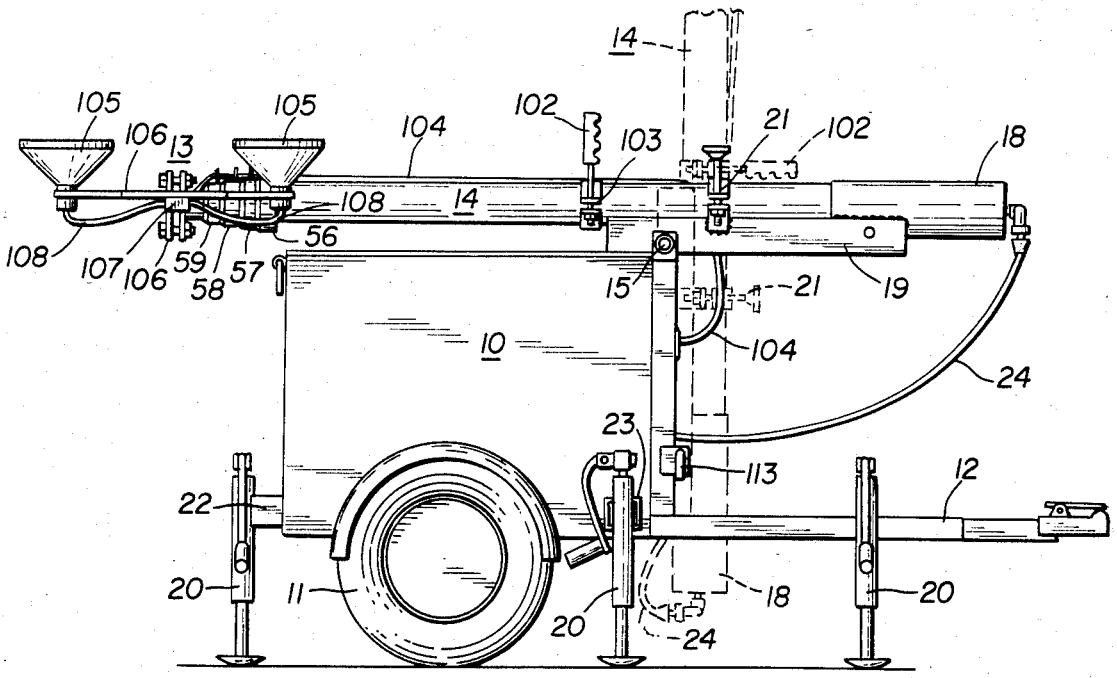
FIG. 1 is a side elevation view of a vehicle trailer provided with floodlighting equipment mounted on a mast embodying the invention.

Referring now to the drawings, FIG. 1 illustrates a portable floodlighting equipment of the general type which has come into wide use for the temporary lighting of construction areas and the like. The equipment comprises a body 10 mounted on a trailer having wheels 11 and a hitch or tow bar 12. The body encloses an engine-driven generator unit (not shown) for supplying electric power to the light assembly indicated at 13, and an air compressor unit (not shown) for supplying compressed air for raising the mast. The light assembly is mounted on an extensible mast 14 which embodies the present invention. The mast is pivotably mounted on a horizontal pivot 15 and may be rotated to its upright position as indicated by dotted lines. The base of the mast is mounted in a cylinder or socket 18 which is rigidly secured to a cradle 19 rotatable on the pivot 15, the mast being secured to the cradle by a clamp 21. When the equipment is located in the position in which it is to be used, it is stabilized by a plurality of jacks 20 which are secured to the tow bar 12 and to outwardly extended arms 22 and 23.

When the trailer has been positioned and the jacks secured, the mast is rotated manually to its upright position. Air under pressure then is supplied through a pressure hose 24 and the telescoped sections thereby are raised to the required elevation.

Preferably the mast is constructed of light metal, such as aluminum alloy, of adequate strength. The mast thus is light and may be easily moved manually between its horizontal and upright positions. Furthermore, the lightweight construction facilitates the handling and the transportation of the equipment by aircraft.

Telescoping members or sections of a tower when constructed of lightweight metal may tend to be erratic in movement due to the much lower momentum of the mass of the tower. Accordingly, it is desirable to provide features of construction which will overcome this disadvantage and facilitate the smooth and uniform movement of the telescoping sections. The structural features of telescoping masts or towers embodying the present invention provide steady and smooth movement of the telescoping members and resulting reliable operation of the mast during the raising and lowering operations. The construction of this invention avoids metal-to-metal engagement of the moving parts so that it prevents galling of the aluminum or other light metal and minimizes any tendency of the telescoping parts to bind.

Figure 2:
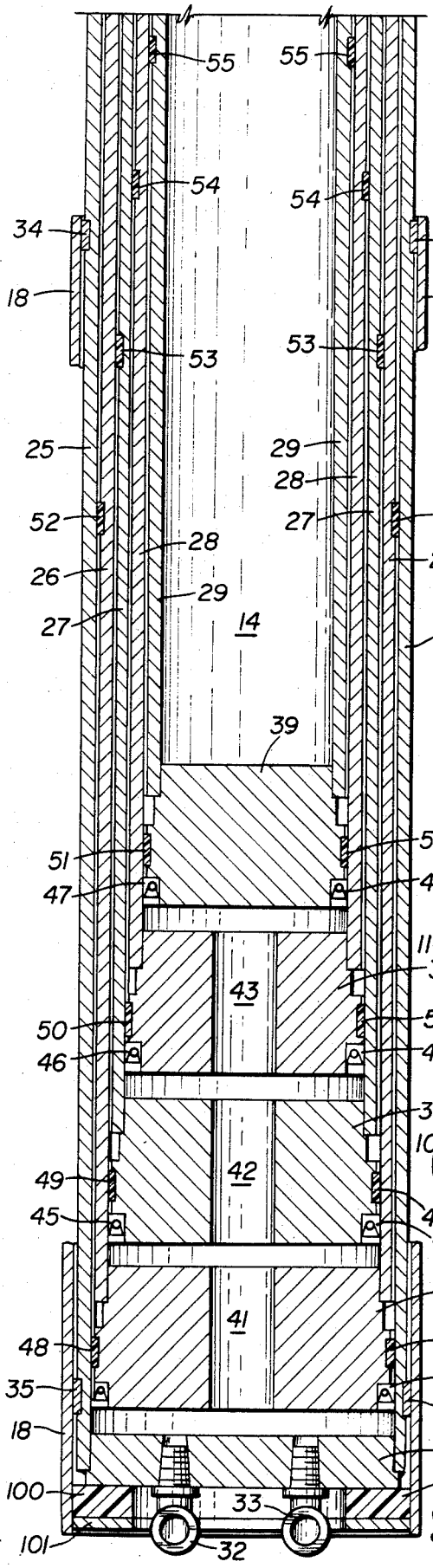
FIG. 2 is a longitudinal section of the lower portion of the mast when collapsed.
Figure 3:
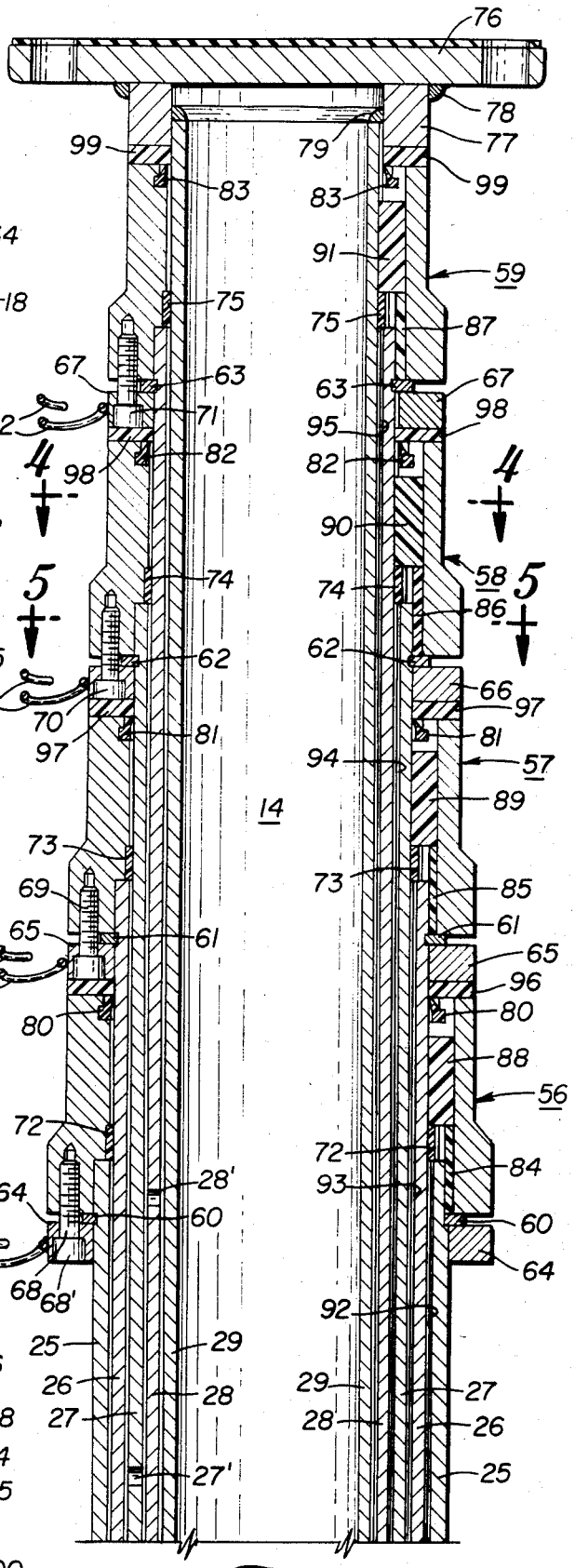
FIG. 3 is a longitudinal section of the upper portion of the mast when collapsed.

The construction of the mast assembly 14 is shown in FIGS. 2 and 3. The mast mounted in the base cylinder or swivel socket 18 comprises a main cylinder or member 25 and a set of successively smaller cylinders or sections 26, 27, 28, and 29 telescoped therein. The main member has a closure plate 31 welded or otherwise suitably secured and sealed to its bottom end. A compressed air inlet connection 32 is provided for receiving air from the supply hose 24 and an air outlet connection 33 is provided in the plate for connection to the outlet air control. The main cylinder 25 has a pair of spacing rings 34 and 35 located in annular grooves in its outer wall; these rings engage the inner wall of the socket 18 near the top and bottom thereof and maintain the desired spacing of the main cylinder in the base cylinder and also facilitate the insertion of the main cylinder in the base cylinder.

The telescoping members 26, 27, 28, and 29 have piston blocks welded or otherwise securely attached to their bottom ends and designated by the numerals 36, 37, 38, and 39, respectively. These blocks are of a radius less than the inside diameter of the member in which they fit, their outermost wall portions being in alignment with the outer walls of the telescoping members on which they are mounted. The block 39 of the innermost telescoping member 29 constitutes the closed end of the pneumatic chamber formed by the telescoping members. The piston members 36, 37, and 38 have central openings 41, 42, and 43, respectively, for providing a passage for air under pressure into the space below the piston 39.

In order to prevent the passage of compressed air around the piston blocks 36, 37, 38, and 39, circular seals 44, 45, 46, and 47, respectively, are mounted in annular recesses provided at the bottom ends of the pistons.

For the purpose of maintaining the desired spacing between the telescoping cylinders at all times, split wear and spacing rings 48, 49, 50, and 51, respectively, are mounted in annular grooves provided in the outer walls of the piston blocks. These wear rings extend beyond the walls of the blocks a distance about equal to the spacing of the telescoping members from one another and maintain this spacing. The wear rings are sufficiently free to adjust their positions radially and circumferentially in their mounting grooves and afford free sliding movement of the telescoping members while maintaining the predetermined spacing of the members. The slight movability for adjustment of the wear rings in their annular grooves serves to minimize jamming and increased resistance to movement of the telescoping sections of the masts throughout the long path of travel between adjacent sections.

The wear rings are made of a suitable self lubricating plastic material. It has been found that a highly effective plastic material is nylon impregnated with molybdenum bisulfide.

Each of the telescoping members 26, 27, 28, and 29 is provided with a second wear ring 52, 53, 54, and 55, respectively. These second rings have essentially the same characteristics as the spacing rings 48, 49, 50 and 51. These second rings act as stops to limit the upward or outward movement of the telescoped members with respect to one another. The spacings of these rings with respect to the bottoms of the members determines the length of overlap of the telescoped members in their extreme extended positions. This manner in which the rings limit the movement of the members is set forth in the following description of FIG. 3 which illustrates the upper end of the collapsed mast assembly and FIG. 6 which shows the innermost mast section in its "stop" position.

Figure 7:
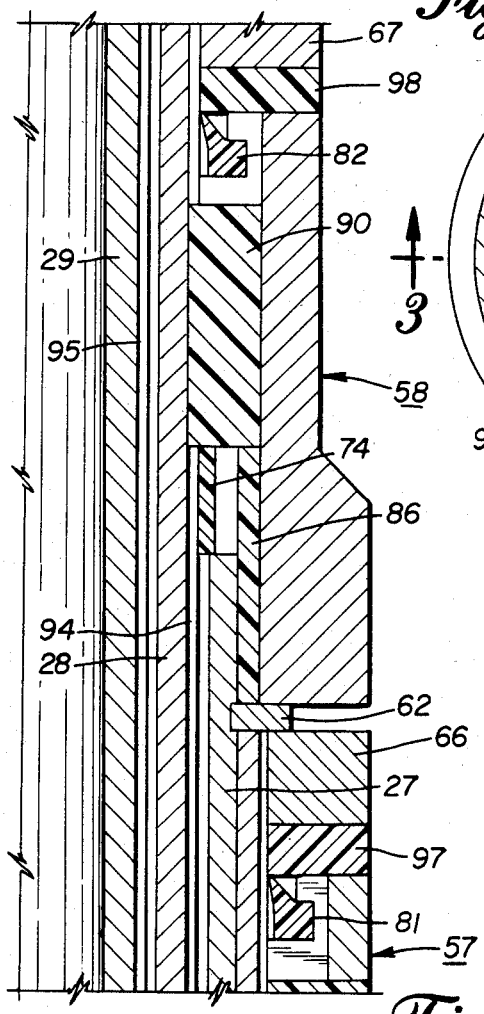
FIG. 7 is an enlarged partial longitudinal sectional view of one of the mast fittings of FIG. 3.

As shown in FIG. 3, the telescoped members 25, 26, 27, and 28 have cylindrical fittings 56, 57, 58, and 59, respectively, made of a lightweight aluminum alloy and secured to the top ends of the members. Each of these fittings is of the same construction and has a diameter to fit its respective telescoping member. Each fitting is detachably secured to its telescoping member by a respective one of four resilient steel split rings 60, 61, 62, and 63 which are retained in annular grooves in the respective members. In order to secure the fittings to the split rings, respective clamping rings 64, 65, 66, and 67, made of the same metal as the fittings, are attached to the fittings by sets of screws or bolts 68, 69, 70, and 71, respectively, which clamp the split rings securely between the respective clamping rings and fitting and hold the fitting tightly in place on the telescoping member. Each set of screws comprises four screws equally spaced circumferentially; the screws are illustrated as having cylindrical caps or heads. The details of construction of the fittings are shown more clearly in the enlarged view of FIG. 7 which shows the fitting 58 and the top end of the fitting 57.

For purposes of illustration, the sectional view of FIG. 3 has been taken along two planes extending from the central axis at different angles so that the bolts are shown on the left-hand half and a section between the bolts is shown on the right-hand half. The line along which the sections are taken is indicated at 3—3 in FIG. 4.

Figure 6:
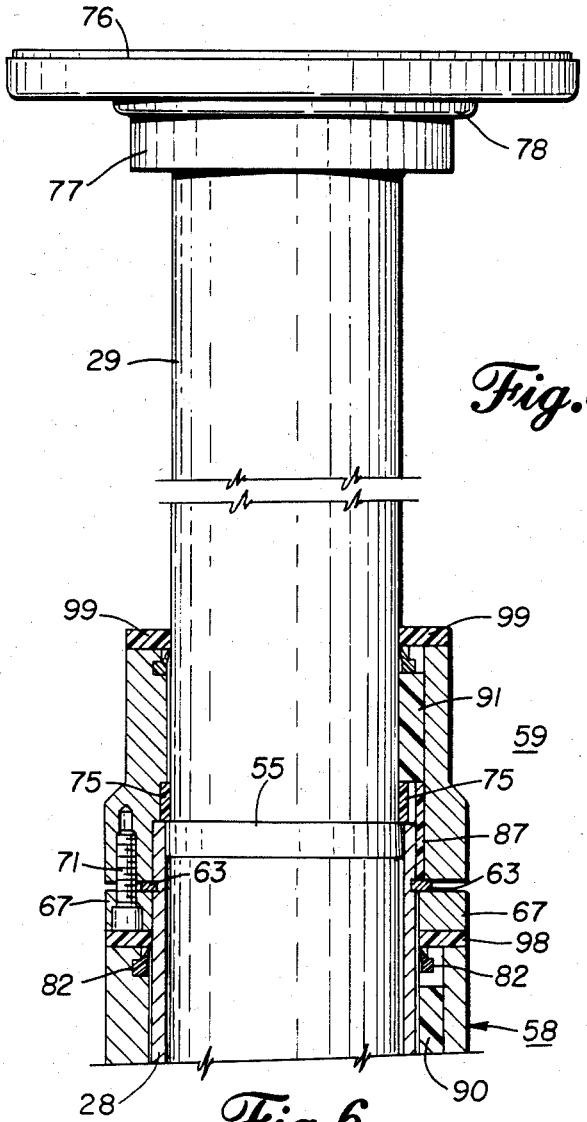
FIG. 6 is a longitudinal section of the top member of the mast when fully raised with the wear rings in their stop positions.

The internal diameter of each fitting is the same as that of the telescoping member to which it is secured. Thus the internal walls of the fittings and of the respective members are in alignment and flush with one another. An internal annular groove is formed between the top of each member and a shoulder on the fitting. Spacing and wear rings 72, 73, 74, and 75, respectively, which are of essentially the same construction and characteristics as those previously described, are mounted in the internal annular grooves of the fittings 56, 57, 58, and 59, respectively. These wear rings extend inwardly from their grooves into engagement with the next smaller telescoping member which slides within the fitting; and in this position, each ring is in the path of a respective one of the wear rings 52, 53, 54, and 55. Thus, when the upper external wear rings on the inner members reach their top positions, they engage and are stopped by the respective internal rings on the fittings. Each internal telescoping member is stopped at its limiting position in this manner and is held in the predetermined overlapped position in the respective external member. This stop position for the innermost member 29 is shown in FIG. 6 wherein the second wear ring 55 on the telescoping member 29 is in engagement with the wear ring 75 on the fitting 59. Each internal telescoping member is maintained in its radially spaced position from the next external member by the three wear rings which remain in engagement with both the internal and external members and thereby maintain this spacing, each ring being mounted on one member and slidably engaging the other.

The top of the innermost cylindrical telescoping member is closed by a plate 76 on which the light assembly is mounted as indicated in FIG. 1. The plate is welded to a ring 77 about the outer circumference of the ring as indicated at 78, the top of the member 29 being inserted in the ring and welded thereto about its inner circumference at 79. The top of the member is sealed by the welds and the pressure fluid cannot escape.

In order to prevent the escape of pressure fluid about the tops of the respective external members, the fittings 56, 57, 58, and 59 are provided with annular seals 80, 81, 82, and 83, respectively. These seals are maintained resiliently in sliding engagement with the internal members. A seal is effected between each fitting and the telescoping member on which it is mounted. When the bolts are tightened, the clamping ring and the fitting are pressed together against the split ring; this pulls the fitting and ring tightly together and forces the top end of the telescoping member toward the wear ring in the internal groove of the fitting.

It is desirable to equalize the pressures in the spaces between the telescoping members. For this purpose, as shown in FIG. 3, holes indicated at 27 and 28' are provided in the members 27 and 26, each hole being located a distance from the wear ring in the fitting about equal to the overlap of the telescoped members in their top positions. Thus these holes remain open until the respective inner member 29 or 28 reaches its stop position, and air may be moved through the hole until the inner and moving member has stopped against the wear ring 75 or 74, respectively. A similar hole (not shown) is provided in the member 26.

Figure 4:
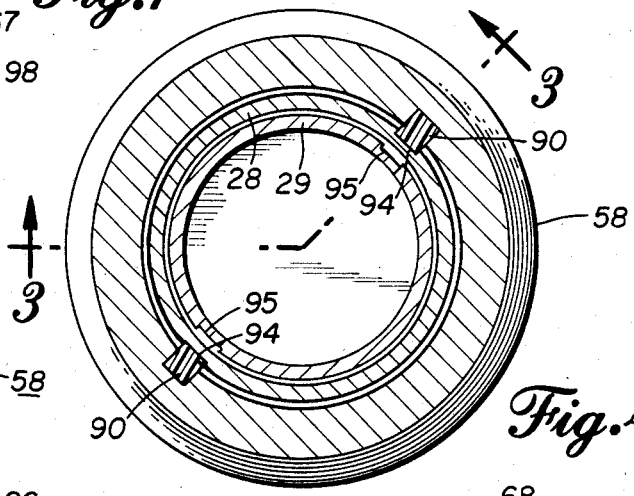
FIG. 4 is a slightly enlarged cross section of the mast taken along the line 4—4 of FIG. 3.
Figure 5:
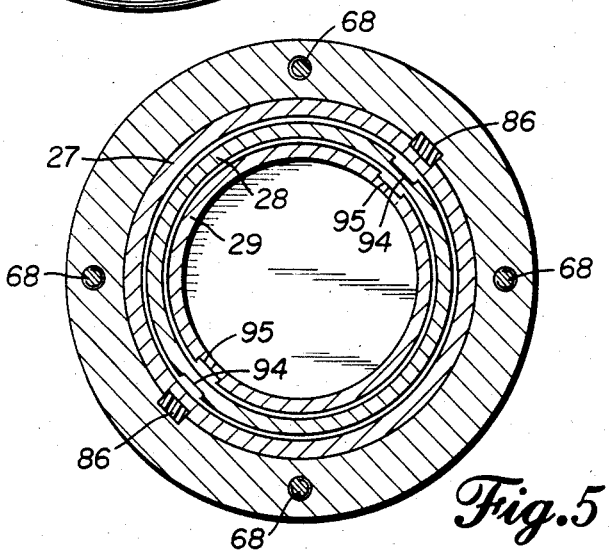
FIG. 5 is a slightly enlarged cross section of the mast taken along the line 5—5 of FIG. 3.

In order to hold the light assembly 13 fixed in position, the telescoping members are prevented from rotating with respect to one another. The light assembly thus is prevented from rotating with respect to the members. For this purpose, straight longitudinal grooves are provided in the members and extend from the annular grooves for the intermediate or second wear rings to the top of the member, and two keys are slidably mounted in each fitting, the first to prevent relative rotation of the fitting and the next inner member which slides through it and the second to prevent relative rotation of the fitting and the member on which it is mounted. These keys are shown in FIGS. 3, 4, and 5. In FIG. 3, the first of these keys for each of the fittings 56, 57, 58, and 59 is shown at 84, 85, 86, and 87, respectively, and the second keys are indicated at 88, 89, 90, and 91, respectively. The longitudinal grooves along the members 26, 27, 28, and 29 are shown on the left-hand portion of FIG. 3 at 92, 93, 94, and 95, respectively. Two of these longitudinal grooves are provided on each member on opposite sides from one another as illustrated in FIGS. 4 and 5 in which the two grooves 94 are shown in section.

To minimize the effects of jarring or pounding of the fittings, bumper rings 96, 97, 98, and 99 are glued to the top ends of the fittings 56, 57, 58, and 59, respectively; the bumper rings are constructed of a tough wear-resisting plastic material such as that of the wear rings. When each telescoping member is lowered, its fitting strikes and comes to rest on the bumper ring of the fitting below so that there is no metal-to-metal contact. The outer member 25, which is supported in the socket 18, rests on a shock-absorbing plastic ring 100 which may be made of neoprene and is mounted on an in-turned flange 101 at the bottom of the socket. The ring 100 acts as a thrust bearing for the mast when it is upright and the base or bottom section is turned to adjust the position of the light assembly.

In order to turn the mast within the socket 18, the clamp 21 is released and the mast turned by gripping and turning a handle 102 which is attached to the mast by a clamp 103 as shown in FIG. 1. The turning of the mast in most cases will be done when the mast is in its upright position and resting on the ring 100.

OPERATION

Power for energizing the lights is supplied from a generator in the trailer body 10 through a cable 102 shown in FIG. 1. The lights indicated at 104 and 105 are mounted on a bracket 106. Two such pairs of lights may be provided, the brackets 106 being mounted at the opposite ends of a cross arm 107 which is secured at its center to the mast plate 76. The cable 103 extends up the mast and ends in branches 108 which supply the individual lights. In order to guide the cable 103 laterally, open ringlike guides 109, 110, 111, and 112 are provided on the clamping rings 64, 65, 66, and 67, respectively. The cable then is inserted laterally into the guides so that it is held near the mast. The guides are of sufficient size to afford free movement of the cable therethrough during the raising and lowering of the mast.

When the mast is to be set up for operation, the trailer is positioned as desired and the jacks 20 are set. The mast then is rotated about the horizontal pivot 15 until it is upright. The mast is locked in the upright position by a latching mechanism (not shown) having a release handle 113. Air under pressure then is supplied through the hose 24 and the mast sections move upwardly until all sections have reached their stop positions. The pressure of the air is maintained while the mast is extended. The position of the lights about the mast axis may be changed by releasing the clamp 21 and turning the handle 102 to bring the lights into their required position. The clamp 21 then is tightened again to lock the mast against turning in the socket 18.

It has been observed that when the mast is rising, the sections may rise in order, first the innermost section and then the others one at a time. However, the sections may move in a different order. It appears that this may result from relatively slight differences in friction of one section with respect to another, the section presenting the lowest frictional resistance moving first. Regardless of the order of movement, the sections move smoothly and without interruption in movement until all sections have reached their stop positions. A very smooth-acting, efficient, and lightweight mast assembly thus has been provided.

METHOD FOR ASSEMBLING THE MAST

Figure 8:
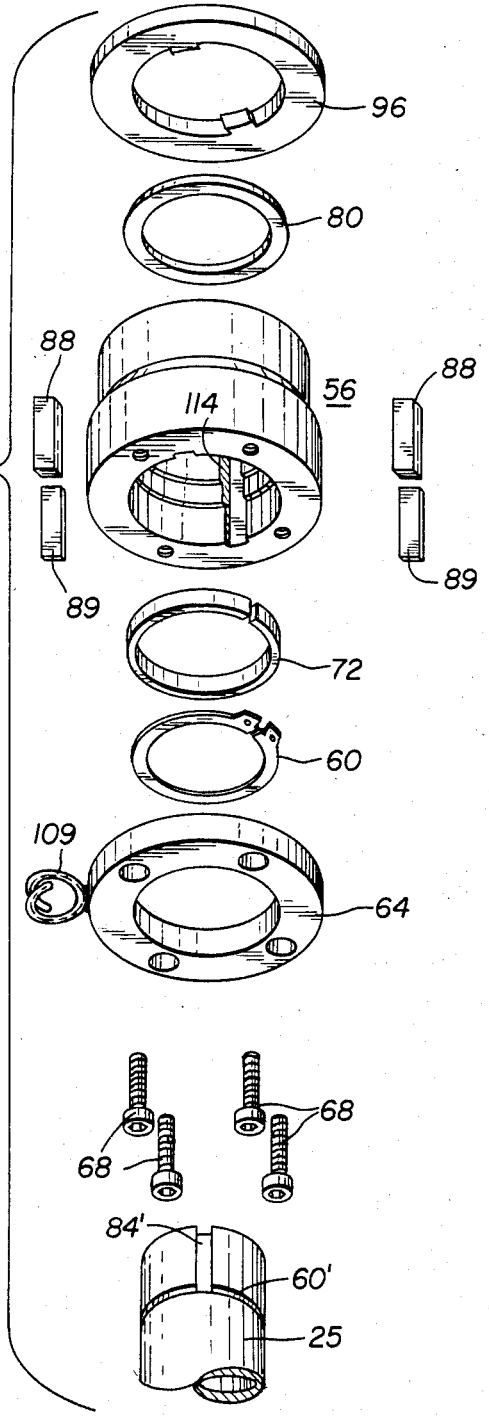
FIG. 8 is an exploded isometric view of a portion of a telescoping member and the fitting assembly therefor.

In preparation for the assembling of the mast, the external wear and spacing rings are mounted on the members which are to be telescoped together. The clamping ring 64 then is placed over the end of the member 25 beyond the annular groove for the split ring 60 and the split ring then is positioned in the groove. The member 26 then is telescoped into the member 25 leaving a substantial end portion outside. The remaining parts of the fitting 56 in the order indicated in FIG. 8 are placed over the end of the cylinder 26, the keys 84 and 88 being positioned in the internal longitudinal slots in the cylinder 56, one of the slots being indicated at 114 in FIG. 8, and the wear ring 72 being positioned against an annular shoulder 115. The cylinder 56 with the seal 80 mounted therein then is moved onto the tube 25 and against the split ring 60. The four screws 68 are installed and tightened to secure the cylinder and clamping ring 64 tightly together against the split ring 60. The bumper ring 96 may be glued to the fitting 56 either before or after the fitting has been secured. The bumper ring, as shown in FIG. 8, has two internal lugs or projections 116 which fit in the longitudinal grooves 92 in the tubular member 26, and provide seals for the groove ends, and minimize the admission of foreign matter to the seal 80.

The same assembling procedure is followed for the members 26 and 27 and their fittings 57 and 58. When the fitting 59 is to be assembled on the member 28, the parts of the fitting are placed in their required order on the tubing member 29 from its bottom end and before it is inserted in the tube 28 and the fitting 59 mounted on the end of the tube 28 in the manner described above. Thereafter, the innermost tube member 29 is locked against withdrawal from the assembly by engagement of the wear ring 55 on the tube 29 and the wear ring 75 in the fitting 59.

The assembly of the telescoping sections of the mast having been completed, the bottom of the section 25 is inserted in the socket 18 and against the ring 100, and the mast is secured by tightening of the clamp 21. After the mast has been assembled in this manner, the mast section 29 is locked within the section 28 by engagement of the wear rings 55 and 75 as shown in FIG. 6. Removal of each of the sections 28, 27, and 26 from the sections 27, 26, and 25, respectively, is prevented in the same manner.

Figure 9:
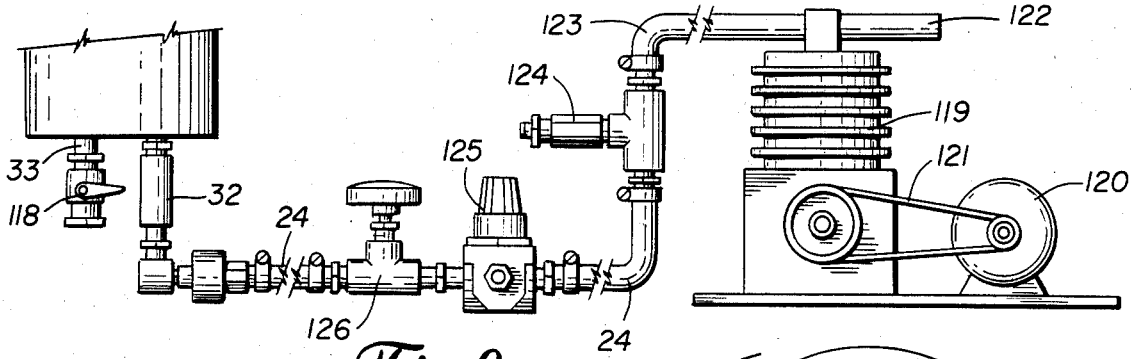
FIG. 9 is a diagrammatic illustration of the compressed air supply system for raising the mast.

After the mast has been assembled, it is mounted on the trailer as shown in FIG. 1; and the lighting assembly 13 is mounted securely on the plate 76. The inlet and outlet fittings 32 and 33 are connected respectively to the compressed air supply in the body 10 and to a manual valve for controlling the discharge of air when the mast is lowered. These connections are shown diagrammatically in FIG. 9 where the inlet 32 is shown connected to the air supply line 24, and the outlet 33 is connected to a manual valve 118. The compressed air is supplied from a compressor 119 driven by an electric motor 120 by a belt 121. The motor is energized from the generator (not shown) which supplies the lighting assembly. During the operation of the compressor, air is supplied through an inlet 122 and is discharged through a line 123 and a pressure-limiting control, or safety valve 124, to the line 24. A pressure gauge 125 is provided in the line 24 to indicate the operating pressure of the system. In order to raise the tower, air is supplied through the connection 32, the valve 118 being closed. Air pressure is maintained while the tower is extended. When the tower is to be lowered, the compressor is stopped and the manual valve 118 is opened to release air from the tower which is lowered as the sections of the tower telescope with one another until they reach their bottom positions against the bumper rings 96, 97, 98, and 99. The tower then may be returned to its horizontal position on the trailer.

The reliable, effective, and smooth operation of the light metal sections during the raising and lowering of the mast provides a portable lighting equipment which may be moved easily from place to place and quickly erected for use. The telescoping mast is entirely self-sustained, and a light assembly mounted on the mast may be raised and lowered easily solely by operation of the fluid-pressure controls. The ease of handling the mast and its light weight adapt it admirably for use where transportation by air is required.

While the invention has been described in connection with one specific equipment, various other modifications and applications will occur to those skilled in the art. Therefore, it is not desired that this invention be limited to the particular construction illustrated and described and it is intended by the appended claims to cover all modifications within the spirit and scope of the invention.

We claim:

1. A telescoping tower mast assembly or the like for elevating equipment to a raised position comprising a hollow cylindrical base member and at least one extensible hollow cylindrical member telescoped within said base member, means for admitting pressurized fluid to the interior of said assembly for raising said assembly and for releasing the fluid for lowering the assembly, seals on said members including a seal near the outer end of said base member slidably engaging the next smaller member for preventing the leakage of fluid between said members, means for preventing the escape of fluid through the innermost of said members, means providing open communication through said cylindrical members from said pressurized fluid admitting means to said fluid escape preventing means, each of said members except the innermost member having a fitting at its outer end and respective ones of said seals being mounted in respective ones of said fittings for engagement with the external wall of the inner member slidable therein, a piston block at the inner end of each of said inner members, a first wear and spacing ring on each of said piston blocks for sliding engagement with the next outer member for maintaining adjacent members in predetermined spaced relationship, a second wear and spacing ring mounted on each of said inner members, means for preventing longitudinal displacement of each of said wear and spacing rings with respect to the member on which it is mounted, said second rings spaced a distance from the respective first ring which determines the length of overlap of said members when fully extended, and a third wear and spacing ring mounted internally on each of said fittings for maintaining the spacing of said members adjacent said fittings and for engaging the respective one of said second rings to act as a stop limiting the outward movement of the respective inner member, said wear rings being constructed of a low friction plastic material and the mounting of said wear rings on said members affording slight relative movement of the rings radially with respect to the members on which they are mounted for facilitating the smooth movement of said members with respect to one another.

2. A telescoping mast assembly or the like as set forth in claim 1 wherein said wear and spacing rings are split rings affording their expansion and installation in their respective positions on their respective members, said cylindrical members having annular grooves for receiving and retaining said wear and spacing rings and constituting said longitudinal displacement-preventing means.

3. A telescoping mast assembly or the like as set forth in claim 1 or in claim 2 wherein said rings are constructed of nylon impregnated with molybdenum bisulfide.

4. A telescoping mast assembly or the like as set forth in claim 1 or in claim 2 wherein each of said fittings comprises a rigid body having a central opening for accommodating passage of the respective member slidable within the fitting and spaced therefrom by the respective one of said internally mounted rings, and each of said fittings having its respective seal mounted on the wall of said opening adjacent its outer end for engagement with the outer wall of the inner member to prevent the passage of fluid between the fitting and the outer wall of the inner member.

5. A telescoping mast assembly or the like as set forth in claim 1 or in claim 2 wherein each of said fittings includes means for affording its ready assembly on and removal from its respective telescoping member.

6. A telescoping mast assembly or the like as set forth in claim 4 wherein each of said fittings includes means for affording its ready assembly on and removal from its respective telescoping member.

7. A telescoping mast assembly or the like as set forth in claim 5 wherein each of said members which has a fitting thereon has an annular groove adjacent its outer end, a snap ring mounted in said annular groove, and wherein said ready removal means is adapted and arranged for rigidly clamping said fitting to said snap ring whereby said fitting is secured against longitudinal movement with respect to the member on which it is mounted.

8. A telescoping mast assembly or the like as set forth in claim 1 or in claim 2 wherein said piston on said innermost member constitutes said means for closing the passage through said innermost of said members.

9. In a telescoping tower assembly of the pressure-fluid-operated type including a cylindrical tubular base member and a second tubular member telescoped therein and slightly spaced therefrom, and having at least one wear and spacing ring mounted near its lower end for sliding engagement with the inner wall of said base member, a fitting mounted on the top of said base member for guiding said second member and for preventing the removal of said second member from said base member, said fitting comprising a cylindrical body having a central passage and fitting closely over said second member and a clamping ring and means for securing the clamping ring to the bottom end of said body means including a split ring for mounting said fitting on the upper end of said base member, a second wear and spacing ring mounted on said fitting within said central passage for sliding engagement with the second member, and an annular seal near the top of said fitting for engagement with the second member for preventing the escape of pressure fluid, said wear rings being constructed of a low friction plastic material and the mounting of said wear rings on said members affording radial movement with respect to the members on which they are mounted for facilitating the smooth movement of said members with respect to one another.

10. In a telescoping tower assembly having a fitting as recited in claim 9, the improvement wherein said central passage comprises one section having a diameter for fitting closely over said base member and a second section of smaller diameter of a size for fitting over said second member in flush alignment with the inner wall surface of said base member, and wherein said second wear and spacing ring is mounted within said second section and said seal is mounted in said second section on the side of said second ring remote from said base member.

11. In a telescoping tower assembly having a fitting as set forth in claim 10 wherein said passage is formed to provide a shoulder between said one and said second sections and said second wear and spacing ring is mounted between the end of said base member and said shoulder.

12. In a telescoping tower assembly having a fitting as set forth in claim 9 or claim 10 or claim 11 wherein the base member has an annular groove near its end adjacent said fitting and said split ring is mounted in said groove and extends beyond the outer surface of said base member, and said means for securing said clamping ring includes bolts engaging said body and said clamping ring for securing said body tightly against a portion of said split ring which extends beyond said outer surface.

13. In a telescoping tower assembly of the pressure-fluid-operated type including a cylindrical tubular base member and a second tubular member telescoped therein and slightly spaced therefrom, and having at least one wear and spacing ring mounted near its lower end for sliding engagement with inner wall of said base member, a fitting mounted on the top of said base member for guiding said second member and for preventing the removal of said second member from said base member, said fitting comprising a cylindrical body having a central passage and fitting closely over said second member and a clamping ring and means for securing the clamping ring to the bottom end of said body, means for mounting said fitting on the upper end of said base member, a second wear and spacing ring mounted on said fitting within said central passage for sliding engagement with the second member, an annular seal near the top of said fitting for engagement with the second member for preventing the escape of pressure fluid, said wear rings being constructed of a low friction plastic material and the mounting of said wear rings on said members affording radial movement with respect to the members on which they are mounted for facilitating the smooth movement of said members with respect to one another, the improvement wherein said tubular members each have at least one straight longitudinal groove along its outer wall and including keys slidably mounted in said fitting one of said keys engaging a longitudinal groove in said base member and a second of said keys engaging a longitudinal groove in said second member for preventing relative rotation of said members with respect to one another, said keys being constructed of the same kind of material as that of said wear and spacing rings.

14. A telescoping mast assembly or the like as set forth in claim 1 or in claim 2 wherein said wear and spacing rings are of elongated substantially rectangular cross sectional configuration, the long side of the rectangle extending axially of the mast.

15. A telescoping mast assembly or the like for elevating equipment to a raised position comprising a base member and at least one extensible member telescoped within said base member, means for admitting pressurized fluid to the interior of said assembly for raising said assembly and for releasing the fluid for lowering the assembly, seals on said members including a seal near the outer end of said base member slidably engaging the next smaller member for preventing the leakage of fluid between said members, means for closing the passage through the innermost of said members, each of said members except the innermost member having a fitting at its outer end and respective ones of said seals being mounted in respective ones of said fittings for engagement with the external wall of the inner member slidable therein, a piston block at the inner end of each of said inner members, a first wear and spacing ring on each of said piston blocks for sliding engagement with the next outer member for maintaining adjacent members in predetermined spaced relationship, a second wear and spacing ring mounted on each of said inner members, means for preventing longitudinal displacement of each of said rings with respect to the member on which it is mounted, said second rings being spaced a distance from the respective first ring which determines the length of overlap of said members when fully extended a third wear and spacing ring mounted internally on each of said fittings for maintaining the spacing of said member adjacent said fittings and for engaging the respective one of said second ring to act as a stop limiting the outward movement of the respective inner member, said wear rings being constructed of a low friction plastic material and the mounting of said wear rings on said members affording radial movement with respect to the members on which they are mounted for facilitating the smooth movement of said members with respect to one another and including a bumper ring of tough wear resisting plastic material secured to the top of each of said fittings in position for engagement with the fitting of the next inner telescoping member for minimizing the effects of pounding of the fittings upon the striking of the fitting of each inner member against the fitting of the next outer member.

16. A telescoping mast assembly or the like of the pressure-fluid-operated type including a cylindrical tubular base member and a second tubular member telescoped therein and slightly spaced therefrom, having at least one wear and spacing ring mounted near its lower end for sliding engagement with the inner wall of said base member, a fitting mounted on the top of said base member for guiding said second member and for preventing the removal of said second member from said base member, said fitting comprising a cylindrical body having a central passage and fitting closely over said second member and a clamping ring and means for securing the clamping ring to the bottom end of said body, means including a split ring for mounting said fitting on the upper end of said base member, a second wear and spacing ring mounted on said fitting within said central passage for sliding engagement with the second member, and an annular seal near the top of said fitting for engagement with the second member for preventing the escape of pressure fluid, said wear rings being constructed of a low friction plastic material and the mounting of said wear rings on said members affording radial movement with respect to the members on which they are mounted for facilitating the smooth movement of said members with respect to one another and including a second fitting secured to said inner member near the top thereof in a position to rest against said first mentioned fitting in the collapsed position of said assembly, and a bumper ring of tough wear resisting plastic material secured to the top end of said first mentioned fitting in position for engagement by said second fitting for minimizing the effects on said assembly of pounding of the fittings upon lowering of said inner member against said first fitting.

* * * * *